US008640569B2

(12) United States Patent
Chen et al.

(10) Patent No.: US 8,640,569 B2
(45) Date of Patent: Feb. 4, 2014

(54) FREEWHEEL STRUCTURE

(75) Inventors: Tsung-Jen Chen, Taichung (TW); Chia-Jen Cheng, Taichung (TW)

(73) Assignee: Tsung-Jen Chen, Taichung (TW)

( * ) Notice: Subject to any disclaimer, the term of this patent is extended or adjusted under 35 U.S.C. 154(b) by 0 days.

(21) Appl. No.: 13/459,006

(22) Filed: Apr. 27, 2012

(65) Prior Publication Data

US 2013/0283964 A1 Oct. 31, 2013

(51) Int. Cl.
*F16C 15/00* (2006.01)

(52) U.S. Cl.
USPC ..... 74/572.2

(58) Field of Classification Search
USPC ..... 74/572.2, 572.21, 574.2; 301/53.5, 301/5.21; 310/74; 280/217; 482/57, 64, 93; 474/14
See application file for complete search history.

(56) References Cited

U.S. PATENT DOCUMENTS

| | | | | | |
|---|---|---|---|---|---|
| 131,782 | A | * | 10/1872 | Randall | 74/571.11 |
| 2,957,366 | A | * | 10/1960 | Driver et al. | 74/570.2 |
| 3,248,967 | A | * | 5/1966 | Lewis | 74/573.11 |
| 7,044,022 | B2 | * | 5/2006 | Kim | 74/574.2 |
| 2003/0045404 | A1 | * | 3/2003 | Lin et al. | 482/57 |

* cited by examiner

*Primary Examiner* — Vicky Johnson

(57) ABSTRACT

A freewheel structure includes a wheel frame and at least one weight block. The wheel frame has a central axle portion and a flange portion around an outer edge thereof. The axle portion is for insertion of an axle member. The weight block is selectively located between the axle portion and the flange portion, so that the weight block has a certain distance relative to axle portion. The freewheel will generate a greater centrifugal force when it is rotated at a high speed. The inertial effect of the present invention can be enhanced when the rotational speed is increasing progressively, so the curve of inertial weight is elongated obviously. The whole weight of the freewheel is reduced effectively.

2 Claims, 10 Drawing Sheets

FREEWHEEL STRUCTURE

BACKGROUND OF THE INVENTION

1. Field of the Invention

The present invention relates to a freewheel structure.

2. Description of the Prior Art

FIG. 1 shows a conventional stationary exercise. The frame 90 is provided with a freewheel 2. The other end of the frame 90 is provided with a crank unit 95 which is used to drive the freewheel 2. The user pedals the crank unit 95 to drive the freewheel 2 having a certain weight and to generate a load through a friction pad, a brake pad or a magnetic control member. The freewheel is called acceleration movement. When the crank at one side is turned to the lowermost position, one course of thrust augmentation by left and right legs is completed. The crank continues to turn by inertial force of the freewheel. When passing the lowermost position, the crank goes the next course.

When the freewheel is driven, the weight of the freewheel is used for elongating the curve of the inertial weight and balancing resistance, so the freewheel must have a certain weight to generate an effective curve of the inertial weight. The conventional freewheel is a solid stainless steel wheel. For manufacture, a stainless post having a larger diameter is required to cut and molding. The larger diameter is, the high cost will be. Accordingly, the inventor of the present invention has devoted himself based on his many years of practical experiences to solve these problems.

SUMMARY OF THE INVENTION

The primary object of the present invention is to provide a freewheel structure which can obviously elongate the curve of inertial weight without increasing the weight of the freewheel so as to enhance the exercise effect of an exercise apparatus.

Another object of the present invention is to provide an adjustable freewheel structure. The weight of the freewheel can be adjusted as desired to change the curve of inertial weight for different users.

In order to achieve the aforesaid objects, the freewheel structure of the present invention comprises a wheel frame and a plurality of weight blocks. The wheel frame has a central axle portion and a flange portion around an outer edge thereof. The wheel frame further has a plurality of wheel arms formed between the axle portion and the flange portion. The wheel arms radially extend from the axle portion and are equally spaced. Each of the wheel arms has at least one first locking portion thereon. Each weight block has a second locking portion corresponding to the first locking portion of the corresponding wheel arm.

By using the distance between the weight blocks and the axle portion as the length of the torque, the inertial effect of the present invention can be enhanced when the rotational speed is increasing progressively and the curve of inertial weight is elongated obviously. The cost of the freewheel is reduced effectively.

DETAILED DESCRIPTION OF THE PREFERRED EMBODIMENTS

Embodiments of the present invention will now be described, by way of example only, with reference to the accompanying drawings.

Figure 1:
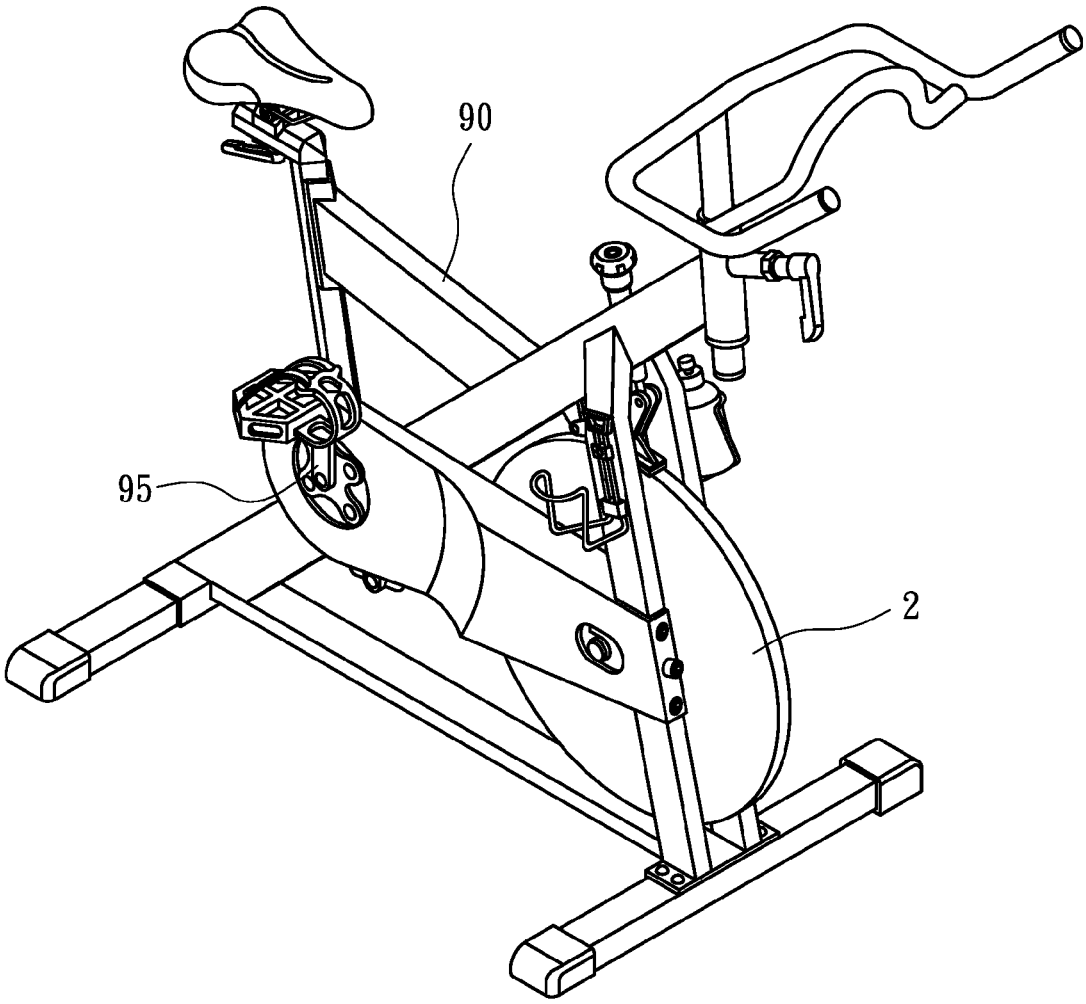
FIG. 1 PRIOR ART
FIG. 1 is a perspective view of a conventional stationary exercise bicycle.
Figure 2:
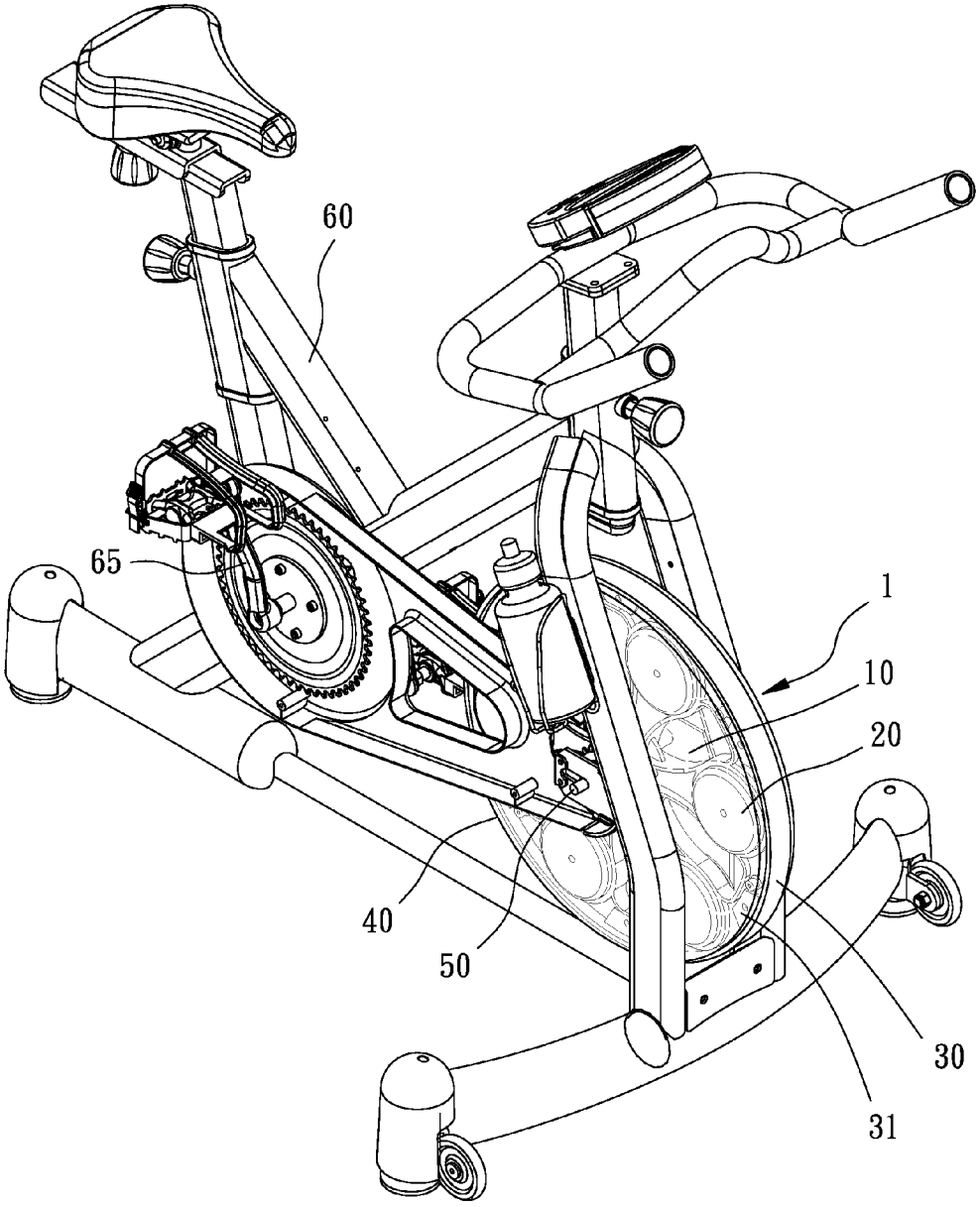
FIG. 2 is a perspective view of the stationary exercise bicycle of the present invention.
Figure 3:
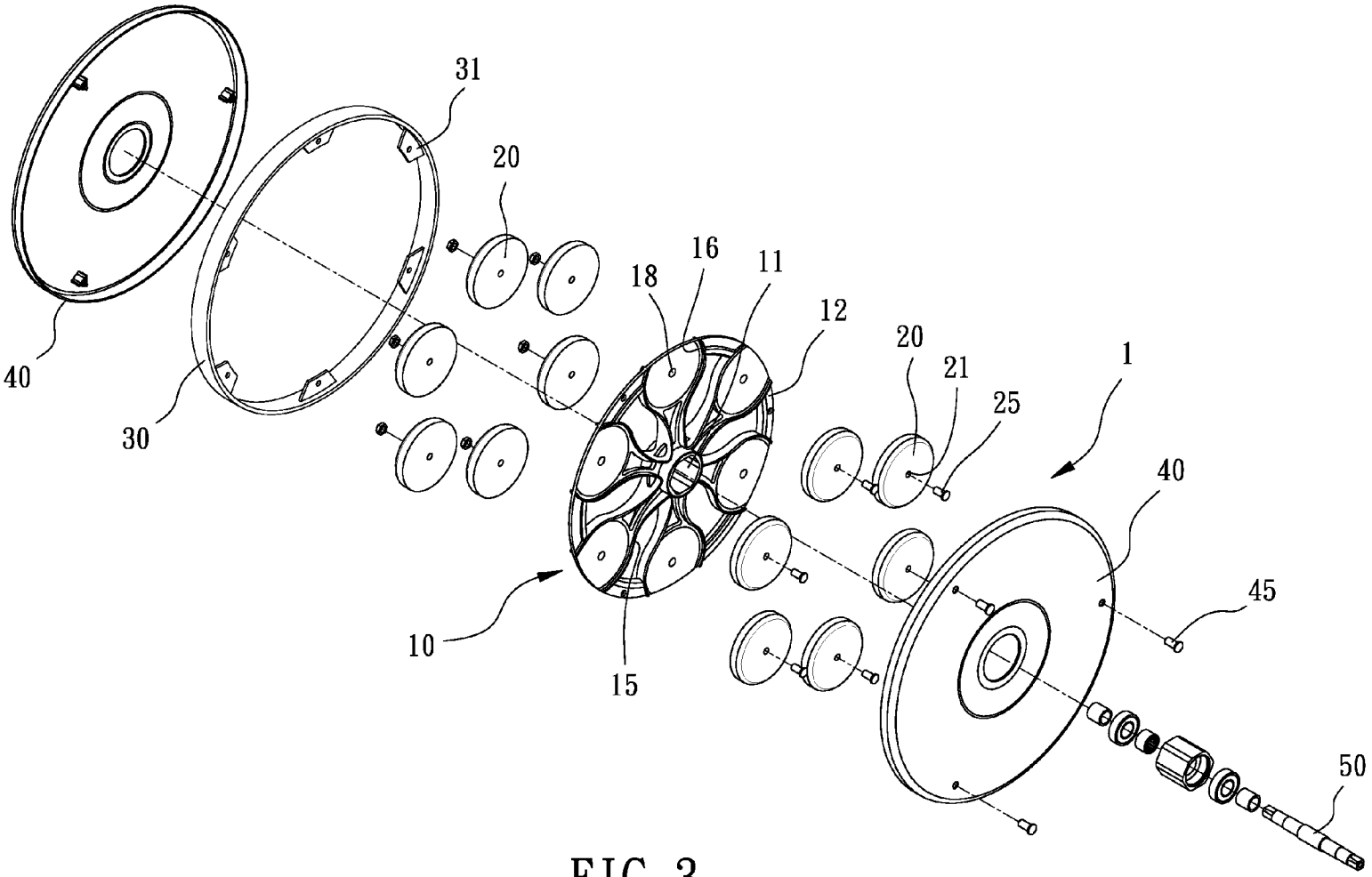
FIG. 3 is an exploded view of the freewheel structure of the present invention.

As shown in FIG. 2, the freewheel 1 of the present invention is mounted on the frame 60 of a stationary exercise bicycle. The frame 60 is provided with a crank unit 65 for the user to pedal. The rank unit 65 and the freewheel 1 on the frame 60 can be coaxial or not coaxial. The user can pedal the crank unit 65 to bring the freewheel 1 to rotate at a high speed. Through the inertial effect of the freewheel 1, two cranks at both sides of the crank unit 65 can be turned smoothly.

FIG. 3 through FIG. 6 show a preferred embodiment of the present invention.

The freewheel 1 comprises a disk-shaped wheel frame 10 and a plurality of weight blocks 20.

The wheel frame 10 has a central axle portion 11 for insertion of an axle member 50. Through the axle member 50, the freewheel 1 is mounted on the frame 60 of the stationary exercise bicycle. The wheel frame 10 has a flange portion 12 around an outer edge thereof. The wheel frame 10 further has a plurality of wheel arms 15 formed between the axle portion 11 and the flange portion 12. The wheel arms 15 radially extend from the axle portion 11 and are equally spaced. In this embodiment, the present invention has six wheel arms 15. At least one of two side walls of each wheel arm 15 is formed with a limit portion 16. In this embodiment, the two side walls of each wheel arm 15 are formed with the limit portion 16. Each wheel arm 15 has a first locking portion 18 formed within the limit portion 16 for connection of the corresponding weight block 20. The distance between the first locking portion 18 and the axle portion 11 is greater than a half of the radius of the wheel frame 10. The first locking portion 18 can be one of a through hole, a threaded hole, a threaded post and a protruding post. In this embodiment, the first locking portion 18 is a through hole for connection of the corresponding weight block 20.

Each weight block 20 can have a different weight and size as desired. For example, the weight of each weight block 20 is one kilogram for the user to count the weight conveniently. Each weight block 20 has a second locking portion 21 corresponding to the first locking portion 18 of the corresponding wheel arm 15. In this embodiment, the second locking portion 21 is a through hole. The weight blocks 20 at two sides of each wheel arm 15 of the wheel frame 10 are fixed within the two limit portions 16 with a locking member 25 so as to lighten the bearing stress of the locking member 25.

The freewheel 1 further comprises a wheel ring 30 fitted on the outer edge of the wheel frame 10. The wheel ring 30 has a plurality of spaced locking pieces 31 on an inner edge thereof. Through the locking pieces 31, the wheel ring 30 is fixed to the flange portion 12 of the wheel frame 10. The wheel ring 30 is a metallic ring and functions as the surface of a magnetic control member, a friction pad or a brake pad.

The freewheel 1 comprises at least one wheel hub 40 disposed at either of the two sides of the wheel frame 10. In this embodiment, the freewheel 1 comprises two wheel hubs 40 at the two sides of the wheel frame 10. The wheel hub 40 is made of a colorful and transparent material, so that the user won't touch the parts inside the freewheel 10 and can see the inner configuration through the transparent wheel hub 40. When the freewheel 1 is rotated at a high speed, the colorful and transparent wheel hub 40 will create streamline and rotational change to enhance its appearance.

Figure 4:
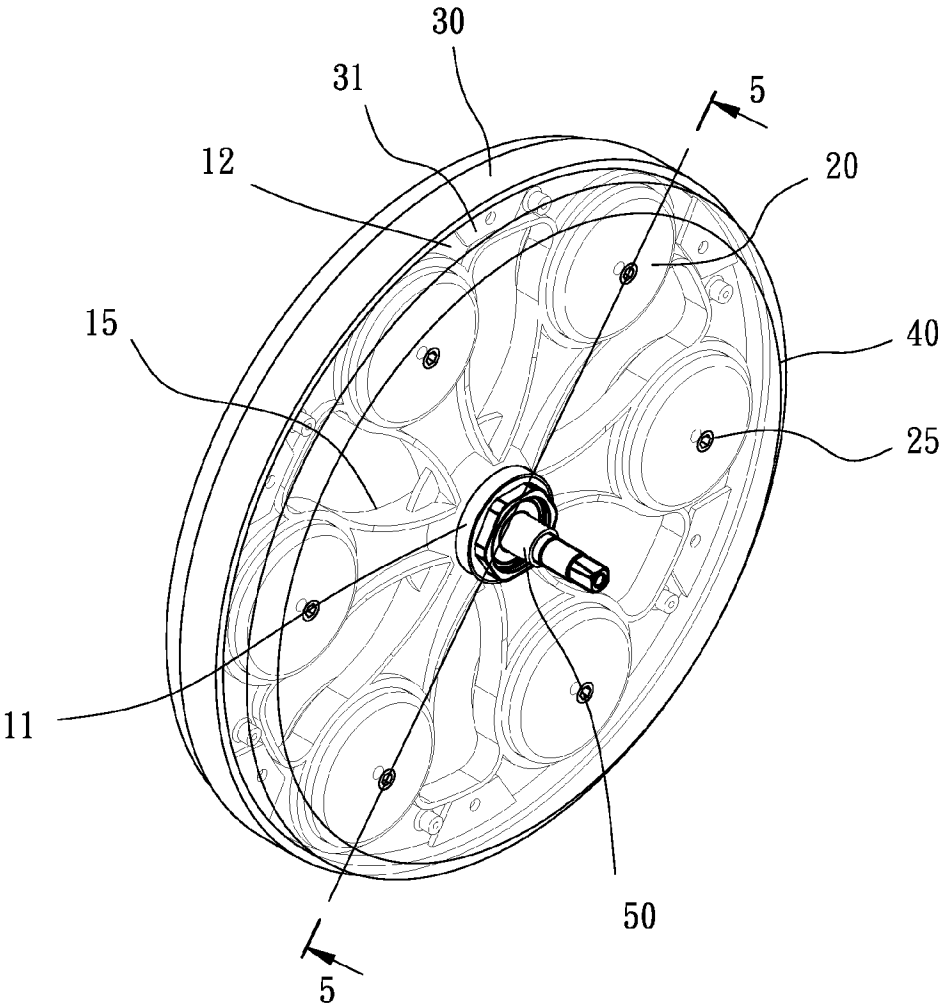
FIG. 4 is a perspective view of the freewheel structure of the present invention.
Figure 5:
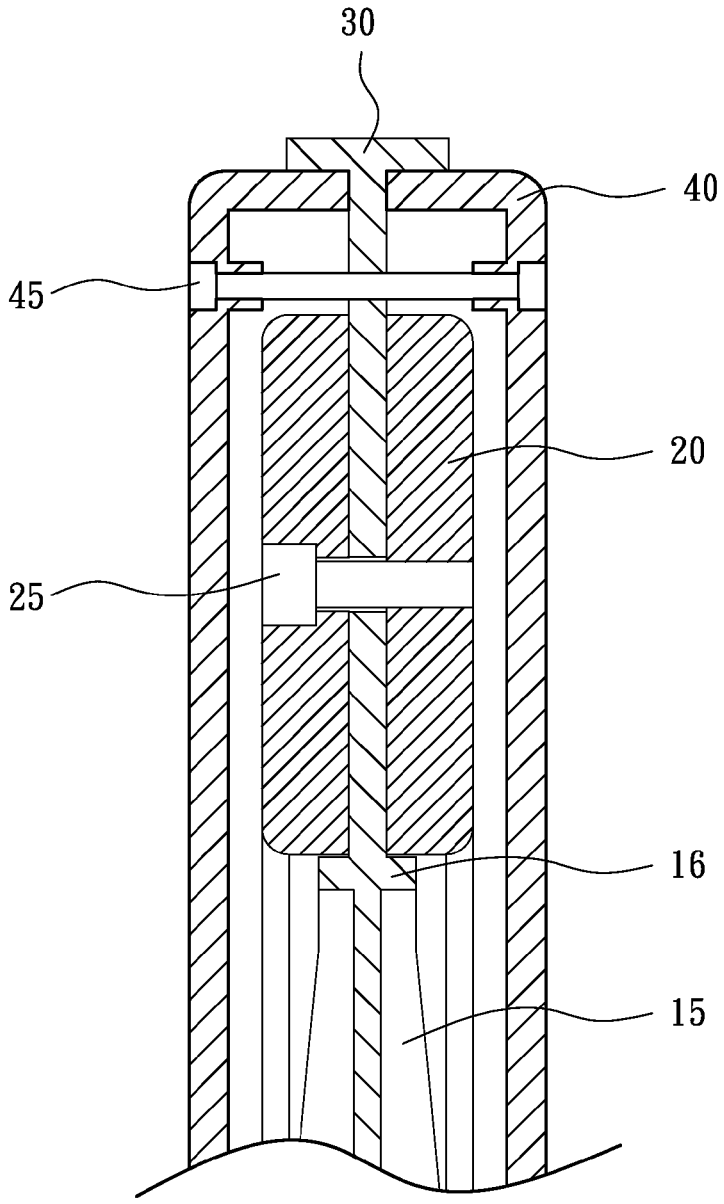
FIG. 5 is a sectional view taken along line 5-5 of FIG. 4.

As shown in FIG. 2 and FIG. 4, when in use, the user pedals the crank unit 65 to drive the freewheel 1. The weight blocks 20 on the freewheel 1 keep a certain distance relative to the axle portion 11 of the wheel frame 10, so the freewheel 1 will generate a greater centrifugal force when it is rotated at a high speed. In general, the longer distance between the same weight block 20 and the axle portion 11 is, the greater centrifugal force will be. Compared to a solid wheel, the distance between the first locking portion 18 of the weight block 20 and the axle portion 11 is greater a half of the radius of the wheel frame 10. With the same weight, the inertial effect of the present invention can be enhanced when the rotational speed is increasing progressively, so the curve of inertial weight is elongated obviously.

Figure 6:
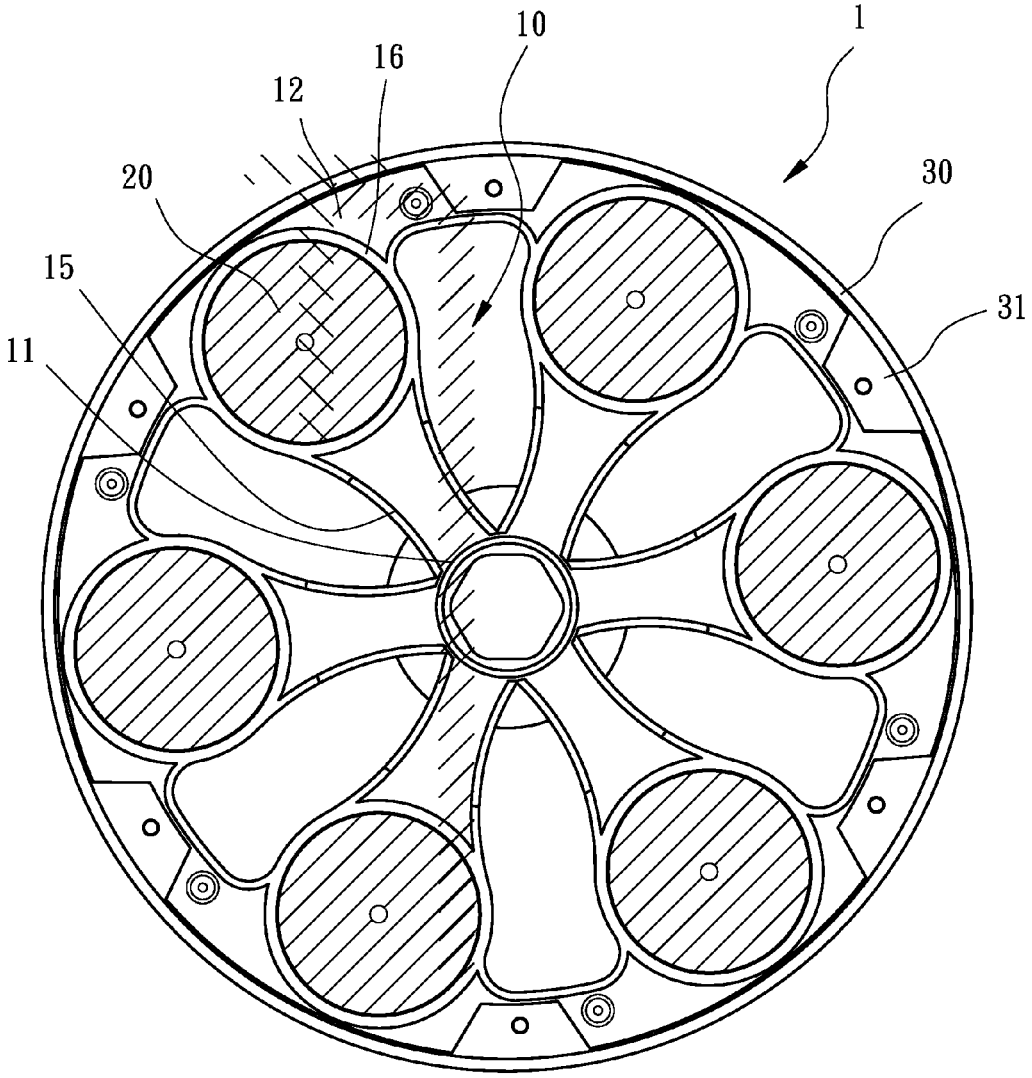
FIG. 6 is a side view of the freewheel structure of the present invention.
Figure 7:
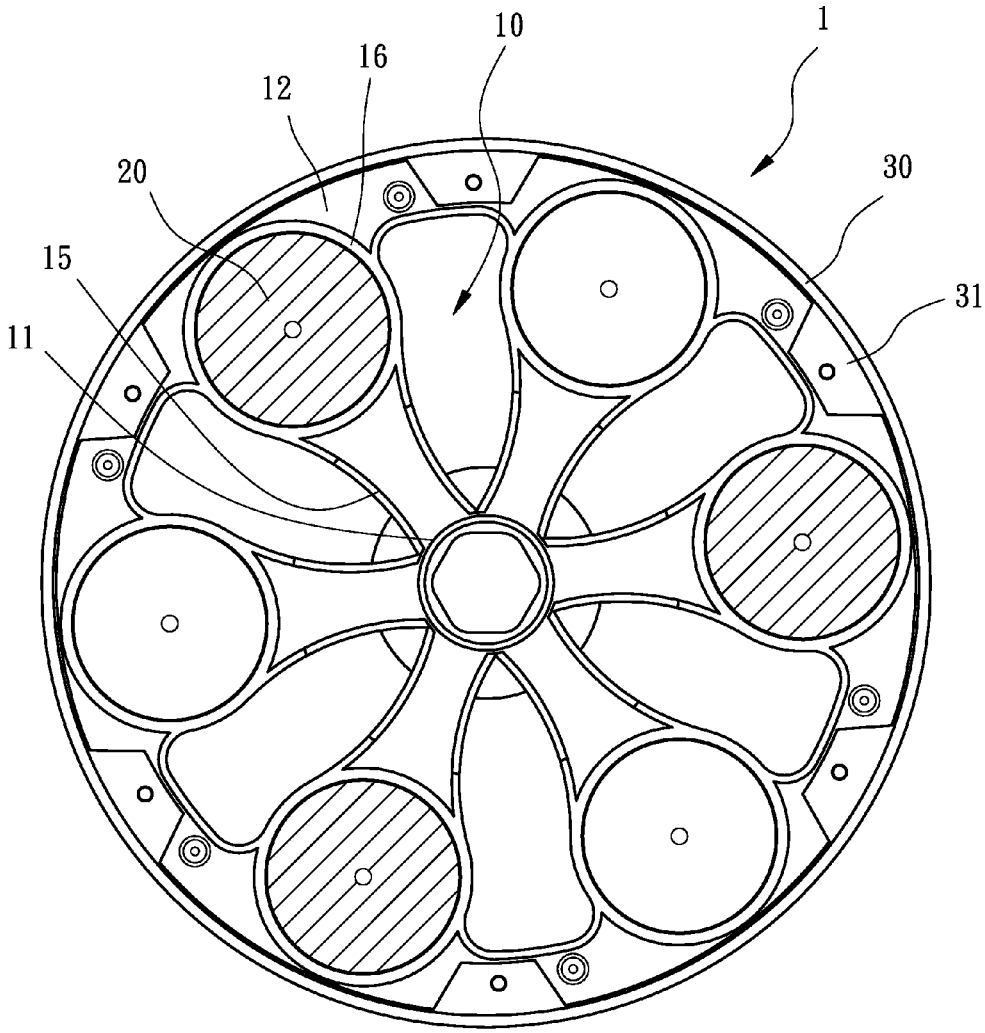
FIG. 7 is a side view of the freewheel structure with fewer weight blocks of the present invention.

As shown in FIG. 6 and FIG. 7, when in use, the limit portions 16 at both sides of each wheel arm 15 of the wheel frame 10 of the freewheel 1 are provided with the weight blocks 20 as desired. The weight blocks 20 can be decreased. As shown in FIG. 7, the weight blocks 20 are spaced at intervals to lighten the whole weight of the freewheel 1 so as to have the same inertial effect as the conventional freewheel. The weight of the freewheel 1 of the present invention can be adjusted as desired.

Figure 8:
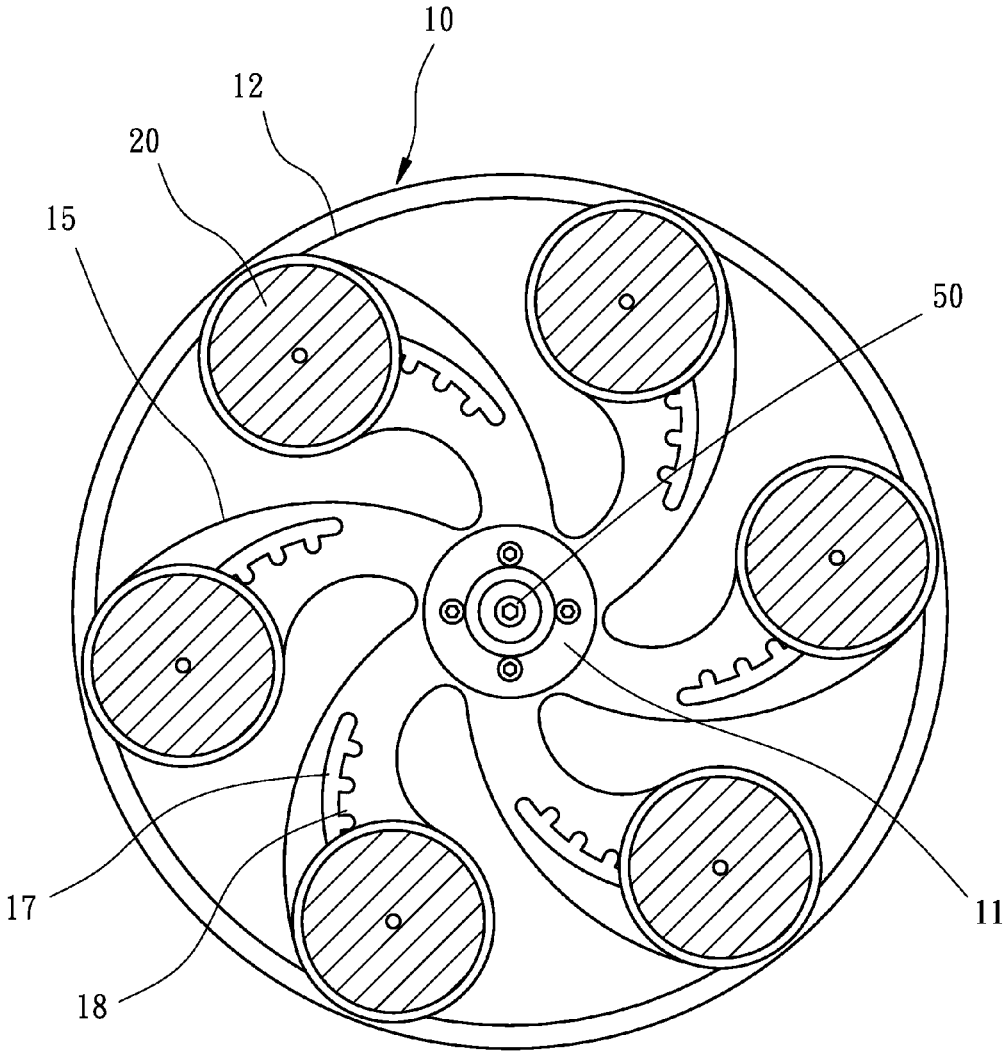
FIG. 8 is a side view of the freewheel structure of another embodiment of the present invention.
Figure 9:
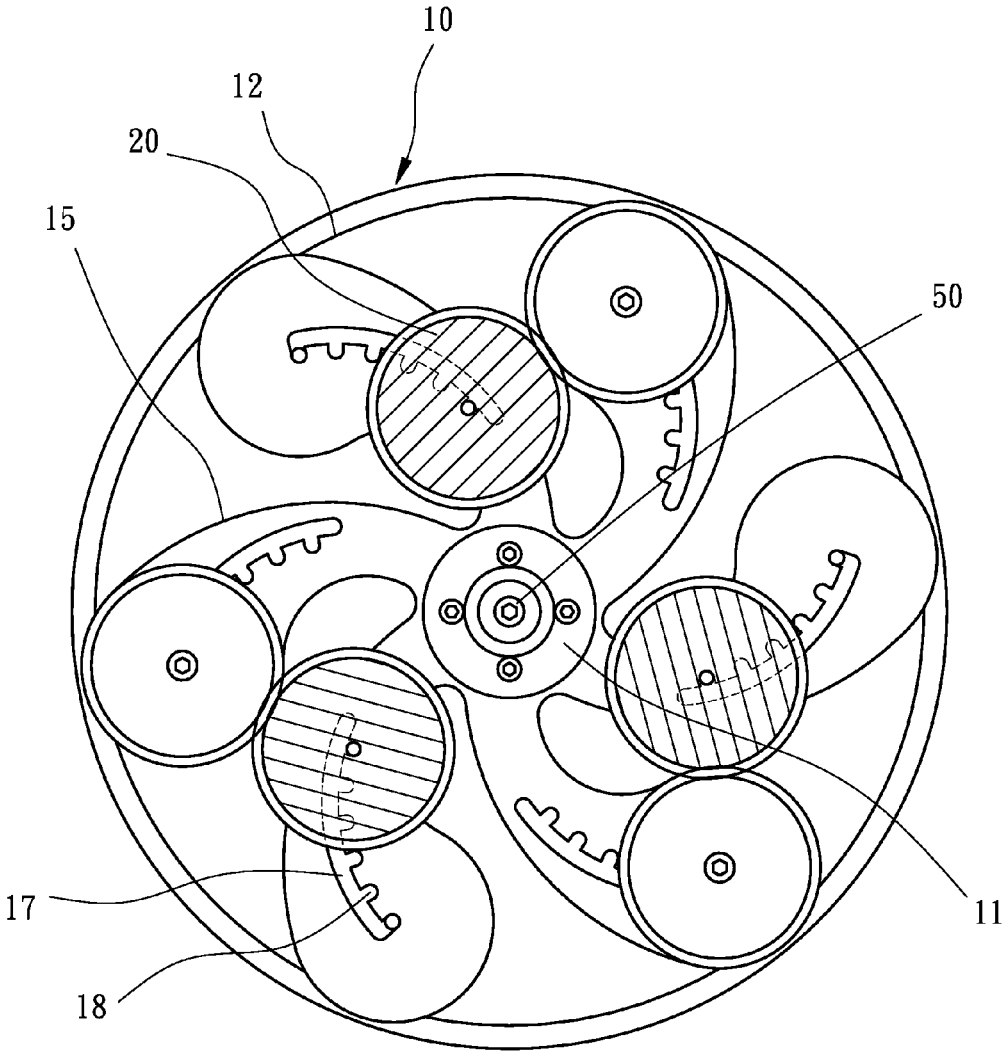
FIG. 9 is a side view showing the weight blocks in a different position of the freewheel structure of another embodiment of the present invention.

FIG. 8 and FIG. 9 show another embodiment of the present invention. The wheel frame 10 further has a plurality of wheel arms 15 formed between the axle portion 11 and the flange portion 12. The wheel arms 15 radially extend from the axle portion 11 and are equally spaced. Each wheel arm 15 is formed with an elongated guide portion 17. The elongated guide portion 17 has a plurality of first locking portions 18 which have different distances relative to the axle portion 11. The elongated guide portion 17 is a slot. The first locking portions 18 are recesses formed at one side of the slot. The weight block 20 can be moved along the elongated guide portion 17 and locked to a desired first locking portion 18 to change the distance between the weight block 20 and the axle portion 11, as shown in FIG. 9.

Figure 10:
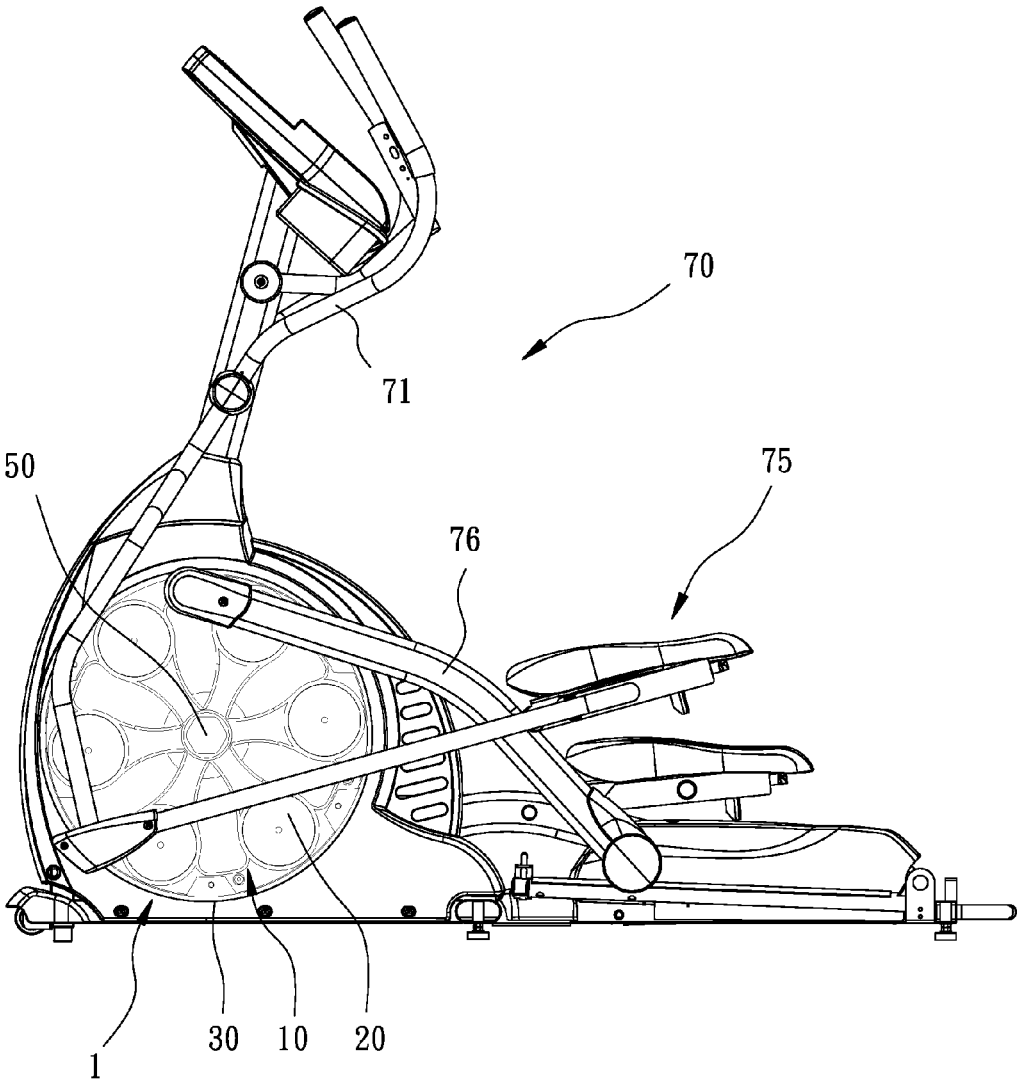
FIG. 10 is a schematic view showing the freewheel structure of the present invention applied to another stationary exercise bicycle.

As shown in FIG. 10, the freewheel 1 of the present invention can be mounted on an oval frame 70. The frame 70 is provided with a pair of handles 71 which can be operated in an interlaced movement. The frame 70 is provided with a pair of pedal units 75 which are disposed at both sides of the frame 70 and linked by the handles 71. The pedal units 75 are pivotally connected to both sides of the freewheel 1 through link rods 76 to generate inertial and load.

The freewheel of the present invention has the following advantages and is very practical.

The freewheel structure of the present invention uses the rotational centrifugal force of the weight blocks 20 which keep a certain distance relative to the axle portion 11 to generate the inertial effect. Compared to the solid freewheel, the freewheel of the present invention has greater centrifugal force. With the same weight, the curve of inertial weight is elongated obviously to enhance the exercise effect of the exercise apparatus.

The freewheel structure of the present invention uses small weight blocks 20 to enhance the inertial weight. Compared to the large solid freewheel, the present invention has less material cost than the prior art and the processing apparatus is a normal one, so the manufacture cost can be reduced greatly.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A freewheel structure, comprising:

a wheel frame having a central axle portion and a flange portion around the axle portion the axle portion, the wheel frame further including guide portions each including a slot extending toward the flange portion from the axle portion and recesses extending in a side of the slot so that the recesses are at different distances from the axle portion; and a plurality of weight blocks each including a second locking portion for resting in a selected one of the recesses of a corresponding one of the guiding portions to retain the inertia of the free wheel in rotation at a selected one of values corresponding to the recesses.

2. The freewheel structure as claimed in claim 1, wherein the wheel frame further has a plurality of wheel arms formed between the axle portion and the flange portion, the wheel arms are equally spaced, and each of the slots is made in a corresponding one of the wheel arms.

* * * * *